United States Patent [19]

Adams

[11] Patent Number: 4,936,260

[45] Date of Patent: Jun. 26, 1990

[54] BOILER OR WATER HEATER WITH INSULATED WATER TANK

[75] Inventor: Charles L. Adams, Fuless, Tex.

[73] Assignee: PVI Industries, Inc., Fort Worth, Tex.

[21] Appl. No.: 297,589

[22] Filed: Jan. 17, 1989

[51] Int. Cl.[5] ..... F22B 5/00

[52] U.S. Cl. ..... 122/13 R; 122/17; 122/392; 122/18; 122/19

[58] Field of Search ..... 122/16, 17, 18, 19, 122/512, 391, 392, 361, 13 R

[56] References Cited

U.S. PATENT DOCUMENTS

| | | | |
|---|---|---|---|
| 2,033,425 | 3/1936 | Graves et al. | 122/19 |
| 2,411,675 | 11/1946 | Alexander | 122/17 |
| 4,373,998 | 2/1983 | Hetrick et al. | 202/258 |
| 4,462,339 | 7/1984 | Jahnke et al. | 122/32 |
| 4,672,919 | 6/1987 | Staats | 122/13 R |
| 4,783,896 | 11/1988 | Stubbe et al. | 122/13 R |
| 4,817,564 | 4/1989 | Akkala et al. | 122/17 |

*Primary Examiner*—Edward G. Favors
*Assistant Examiner*—Denise L. Ferensic
*Attorney, Agent, or Firm*—Charles D. Gunter, Jr.

[57] ABSTRACT

An improved water heater or boiler having a water heater tank, a combustion chamber and a burner wherein a selected insulating material separates the combustion chamber and the tubesheet of the water heater tank to maintain the temperature of the tubesheet below the ductile to brittle transition temperature.

5 Claims, 3 Drawing Sheets

BOILER OR WATER HEATER WITH INSULATED WATER TANK

BACKGROUND OF THE INVENTION

1. Field of the Invention

This invention relates to water heaters or boilers and in particular to means for reducing a failure caused by heating repeatedly above the ductile to brittle transition temperatures.

2. Background Information

Water heaters and boilers typically have a water heater tank, often of the vertical or horizontal tube type which utilizes fire tubes located above a combustion chamber.

In some water heaters or boilers, a fossil fuel power burner is used in the combustion chamber. The tubesheet which separates the combustion chamber from the water is heated by the burning fossil fuel to a relatively high temperature and then cooled when the burner in the combustion chamber is turned off. The tubesheet and water are heated and then cooled repeatedly over a long duration in the life of the water heater or boiler. As a consequence, the tubesheet is heated and cooled repeatedly to temperatures above the ductile to brittle transition temperature and then cooled below this temperature. The result of this repeated heating and cooling above and below the DPTT eventually causes the metal to lose its ductility, become brittle or crystalline and ultimately fail, allowing the discharge of the water and sediment in the water heater or boiler.

SUMMARY OF THE INVENTION

It is therefore the object of the invention to provide a water heater or boiler which overcomes the above problems and disadvantages.

According to this object, the invention may be summarized as an improved water heater or boiler having a water heater tank, a combustion chamber and a burner wherein a selected insulating material separates the combustion chamber and the tubesheet of a water heater or boiler tank to insulate the tank from the thermal gradient and to maintain the temperature of the material of the tank below the ductile to brittle temperature.

Additional objects, features and advantages of the invention will become apparent in the following description.

DESCRIPTION OF THE PREFERRED EMBODIMENT

Figure 1:
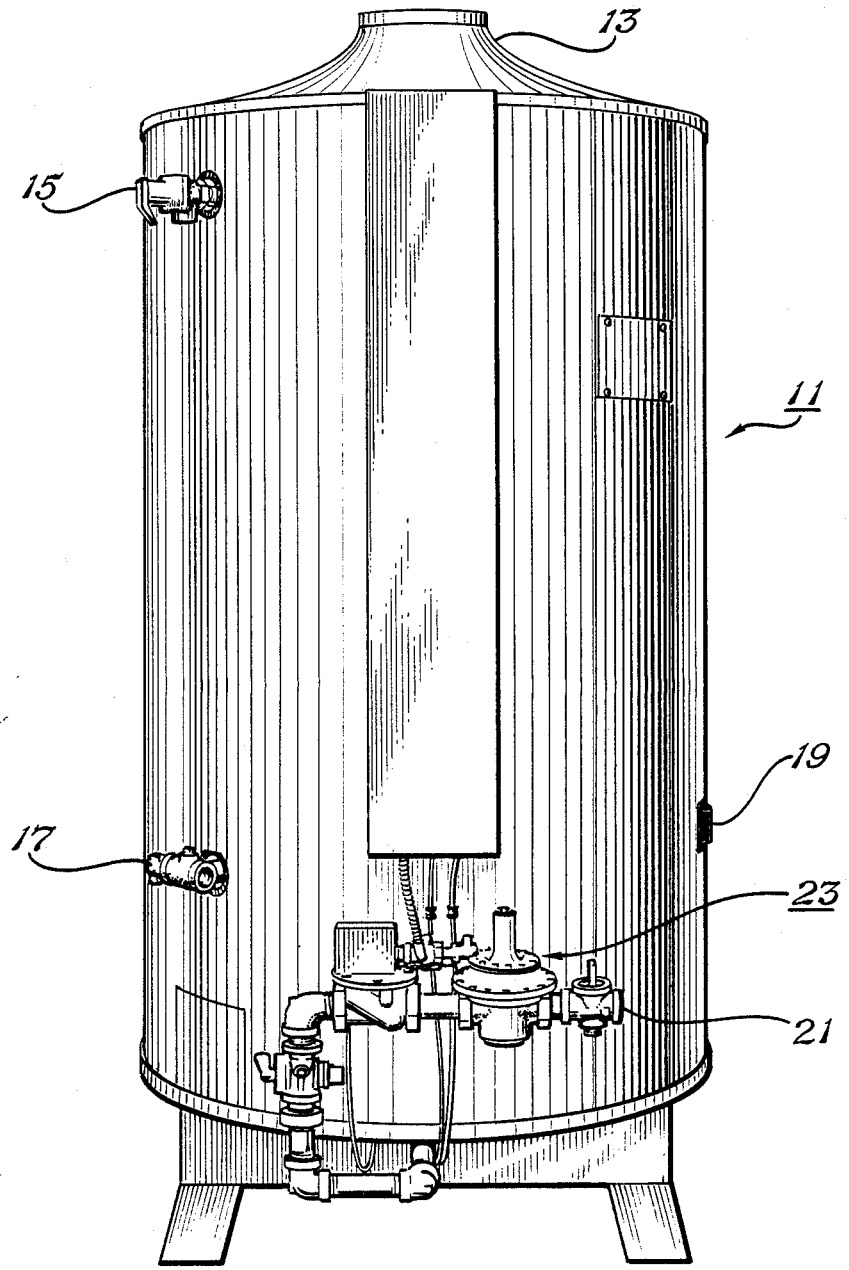
FIG. 1 is a side elevation view of a typical water heater to which is applied the improvement of the present invention.

The numeral 11 in FIG. 1 of the drawing designates a water heater having a flue outlet 13 and an ASME rated relief valve 15 in an upper region. A drain valve 17 and an inlet and relief connection 19 are shown near a lower region, as is a standard natural gas inlet 21 and pressure regulating and flow control system 23.

Figure 2:
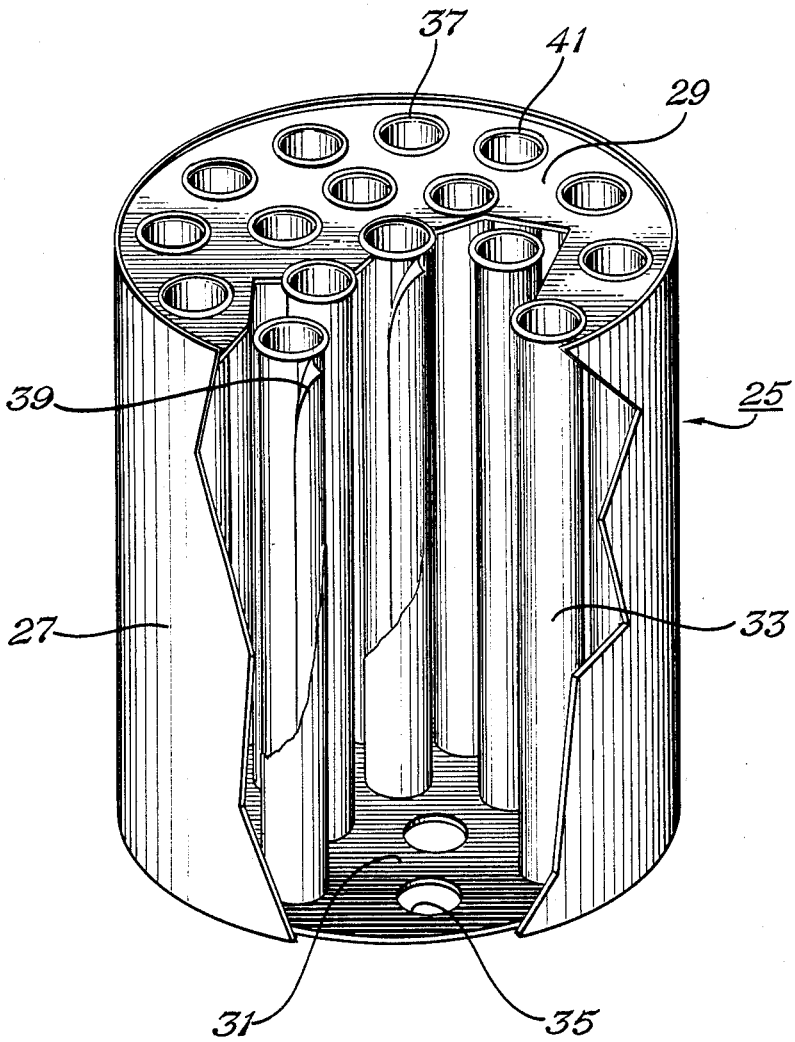
FIG. 2 is a perspective view of a multi-flue water heater tank of the type used in the water heater to FIG. 1.

As shown in FIG. 2, located inside the heater 11 is a water heater tank 25 which includes a cylindrical lateral wall 27, an upper wall 29 and a lower wall 31. Inside the walls are a plurality of fire tubes 33, the lower ends of which are sealingly positioned over apertures 35 in the lower wall or tubesheet 31, and the upper ends over apertures 37 in the upper wall 29. Thus, is provided a multi-flue water heater tank, which is typically lined to inhibit corrosion, often with an electroless nickel which is a nonferrous, corrosion resistant shield.

The fire tubes to 33 are typically clad on the water side with pure copper sheathing 39, a corner of which is peeled to the open position in FIG. 2 for clarity of construction.

Figure 3:
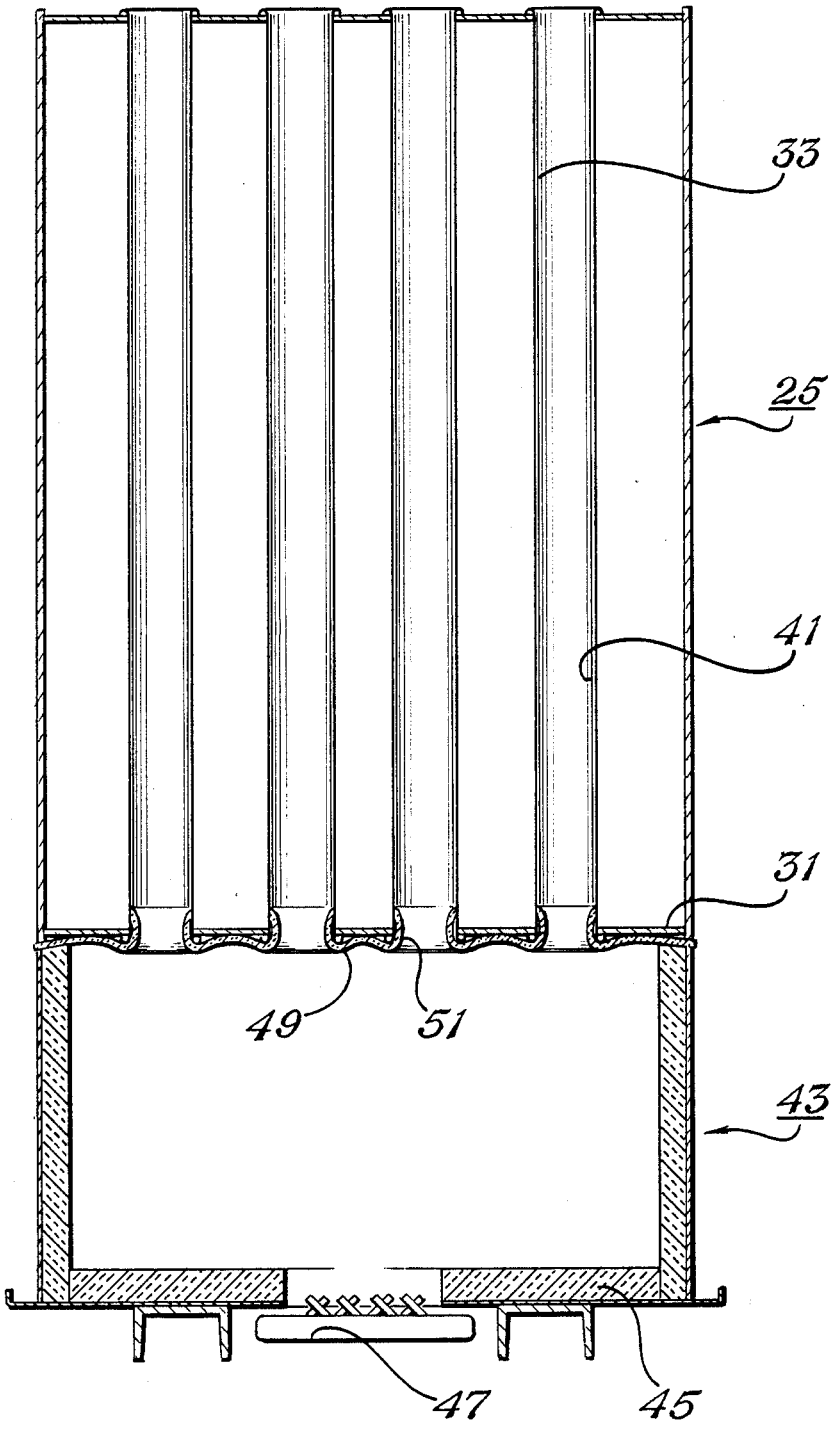
FIG. 3 is a longitudinal section of the water heater tank of FIG. 2 and the combustion chamber beneath the tank.

In the longitudinal section of FIG. 3 the water heater tank 25 and plurality of the fire tubes 33 contain water and are separated by a plurality of flues 41. Beneath the lower wall or tubesheet 31 of the tank is a combustion chamber 43, the walls of which are typically insulated as indicated by the numeral 45. A fossil fuel burner 47 is schematically shown at the bottom of the combustion chamber.

An insulating material 49 is disposed on the lower surface of the lower wall 31 including a plurality of apertures 51 which are folded over into the apertures 35 of tubesheet 31 (see FIG. 2) to insulate the tank 25 and especially its lower wall or tubesheet 31 and to maintain the temperature of the material selected from the construction of the tubesheet, usually steel, below a selected maximum temperature which is the ductile to brittle transition temperature (DBTT). In the case of a steel tank the selected maximum temperature is approximately 700° F. The insulating material is preferably a fibrous refractory capable of withstanding a high temperature in the vicinity of 2300° F. This fibrous material is preferably not less than a minimum of about ¼ inch thick and is sold under various trademarks including "Pyrolite" and "Pyroboard" manufactured by Rex-Roto, Inc. of St. Louis, Mo. A high temperature adhesive is used to attach the fibrous material to the lower tubesheet wall during the manufacturing process. A successful adhesive is a Rosin adhesive from Advance Chemical Technology of Irving, Tex., No. 1–4A-PVI-1.

Tests of a water heater constructed in accordance with the above have shown a significant increase in life since the insulating material 49 on the bottom of the tank maintains the temperature to a level that lengthens the useful life of the tank. The temperature of the lower wall or tubesheet 31 is kept below the ductile to brittle transition temperature and the metal does not become crystalline.

While the invention has been shown in only one of its forms, it should be apparent to those skilled in the art that it is not so limited, but is susceptible to various changes and modifications without departing from the spirit thereof.

I claim:

1. An improved water heater or boiler comprising:

a water heater or boiler tank of selected material;

a combustion chamber connected with the water heater or boiler tank;

a burner in the combustion chamber for the combustion of a selected fossil fuel;

a tubesheet formed from a selected material having a characteristic ductile to brittle transition temperature, the tubesheet being arranged to separate the combustion chamber from the tank;

a plurality of fire tubes, each of the fire tubes having an open interior and opposing ends, one of the opposing ends being selectingly positioned over an aperture provided in the tubesheet, whereby the fire tube open interiors communicate with the combustion chamber; and an insulating material disposed on the tubesheet and separating the tubesheet and the combustion chamber to insulate the tubesheet from the thermal gradient action of burning fuel an to contain the temperature of the selected material of the tubesheet to a selected maximum temperature which is below the ductile to brittle transition temperature of the tubesheet material.

2. The invention defined by claim 1 wherein the selected maximum temperature is about 700° F.

3. The invention defined by claim 1 wherein the insulating material is a fibrous refractory.

4. The invention defined by claim 3 wherein the fibrous refractory material has a minimum thickness of about ¼ inch.

5. An improved water heater or boiler comprising:

a water heater or boiler tank of selected material;

a combustion chamber connected with the water heater or boiler tank;

a burner in the combustion chamber for the combustion of a selected fossil fuel;

a generally planar tubesheet formed from a selected material having a characteristic ductile to brittle transition temperature, the tubesheet being arranged to separate the combustion chamber from the tank, the tubesheet having an upper surface and a lower surface;

a plurality of fire tubes, each of the fire tubes having an open interior and opposing ends, one of the opposing ends being sealingly positioned over an aperture provided in the tubesheet, whereby the fire tube open interiors communicate with the combustion chamber without extending into the combustion chamber;

an insulating material disposed on the tubesheet lower surface and separating the tubesheet and the combustion chamber and the water in the water heater or boiler tank to insulate the tubesheet from the thermal gradient action of burning fuel an to contain the temperature of the selected metal of the tubesheet to a selected maximum temperature which is below the ductile to brittle transition temperature of the tubesheet metal; and wherein the insulating material is folded over into the apertures of the tubesheet whereby the insulating material extends at least partly within the open interiors of the fire tubes.

* * * * *